US005887979A

United States Patent [19]

Ishino et al.

[11] Patent Number: 5,887,979

[45] Date of Patent: Mar. 30, 1999

[54] LINER BAG USED FOR A CONTAINER

[75] Inventors: Minoru Ishino, Yokohama; Susumu Tsunoda, Tokyo, both of Japan

[73] Assignee: Nippon Yusen Kabushiki Kaisha and Nihon Matai Co., Ltd., Tokyo, Japan

[21] Appl. No.: 826,498

[22] Filed: Apr. 3, 1997

Related U.S. Application Data

[62] Division of Ser. No. 348,107, Nov. 25, 1994, Pat. No. 5,639,164.

[30] Foreign Application Priority Data

Nov. 29, 1993 [JP] Japan ..... 5-320910

[51] Int. Cl.[6] ..... B65D 33/14

[52] U.S. Cl. ..... 383/24; 220/1.5; 220/495.06

[58] Field of Search ..... 383/7, 22, 23, 383/24, 71; 220/1.5, 403, 495.06, 495.08

[56] References Cited

U.S. PATENT DOCUMENTS 3,321,070 5/1967 Childs .
3,384,106 5/1968 Isbrandtsen .
3,980,196 9/1976 Paulyson et al. .
4,124,136 11/1978 Bjelland et al. .
4,159,077 6/1979 Hall .
4,674,127 6/1987 Yamada et al. .
4,784,287 11/1988 Yamada et al. .

FOREIGN PATENT DOCUMENTS 3-98887 4/1991 Japan .
42409 9/1923 United Kingdom .

*Primary Examiner*—Stephen P. Garbe
*Attorney, Agent, or Firm*—Longarce & White

[57] ABSTRACT

A liner bag used for a container of a longitudinal box-shaped configuration having a door at one longitudinal end in which the liner bag comprises a bag main body incorporated in the container and connection means for connecting the bag main body at predetermined positions to the container, each of the connection means comprising a ring portion formed by drawing a portion of the bag main body into a strip portion and bending the strip portion and a connection mechanism for connecting the ring portion to the container. Since the ring portion is formed with the bag main body itself, an excess load, if applied, can be prevented from exerting only to a portion of the bag main body thereby enabling to effectively prevent breakage of the bag main body.

2 Claims, 10 Drawing Sheets

LINER BAG USED FOR A CONTAINER

This is a divisional of application Ser. No. 08/348,107, filed Nov. 25, 1994, now U.S. Pat. No. 5,639,164.

BACKGROUND OF THE INVENTION

Field of the Invention and Related Art

The present invention concerns a liner bag used for a container for use in transportation of granular cargoes such as agricultural products, feed stocks, chemicals and chemical products and, in particular, it relates to an improvement to a connection means for connecting a liner bag main body to a container. A container liner bag having a bag main body lined to the inside of a container for loading granular cargoes such as molt to the bag main body has generally been known.

By the way, when the granular cargoes are loaded in the container liner bag of this type, since the bag main body is entirely pulled downwardly by the weight of the cargoes, it is necessary to firmly connect and fix the bag main body to the container, particularly, at four corners of a ceiling face.

In view of the above, it has been adopted so far to dispose a side edge belt along each side edge of the ceiling face of the bag main body in a longitudinal direction and connect to fix both ends of the side edge belt to the container directly or by way of connection metals.

In the existent liner bag of the type described above, the weight of the cargoes is supported by the side edge belts, and breakage of the side edge belts themselves caused by the loading of the cargoes can be prevented completely by increasing the strength of the side edge belts.

However, since the load from the cargoes does not exert evenly over the entire region of seams between the side edge belts and the bag main body but concentrates locally on four corners of the bag main body that are suspended directly by the side edge belts, the four corners of the bag main body may possibly be broken. Particularly, in a case of using the side edge belts, since it is necessary to stitch the side edge belts to the bag main body, stitched regions are formed to the bag main body, which extremely weaken the bag main body at that regions, so that the bag main body tends to be broken easily at the four corners.

OBJECT OF THE INVENTION

The present invention has been achieved in view of the foregoing situation and it is an object thereof to provide a liner bag used for a container which can prevent breakage of the bag main body, facilitate production and reduce the production cost.

Another object of the present invention is to provide a liner bag used for a container capable of facilitating the operation for forming a ring portion and capable of obtaining a strong ring portion.

A further object of the present invention is to provide a liner bag used for a container capable of forming a ring portion even if a strip portion has a short length.

A further object of the present invention is to provide a liner bag used for a container capable of selecting an anti-slip off portion optimal to the material and a production process for the bag main body.

A further object of the present invention is to provide a liner bag used for a container capable of preventing a localized load from exerting on the bag main body even when such a localized load is exerted on the ring portion.

A further object of the present invention is to provide a liner bag used for a container capable of forming the ring portion without using any metal member and sufficiently ensuring a gas tightness at the ring portion.

A further object of the present invention is to provide a liner bag used for a container capable of simplifying the production operation thereby reducing the production cost.

SUMMARY OF THE INVENTION

The foregoing objects of the present invention can be attained by a liner bag used for a container of a longitudinal box-shaped configuration having a door at one longitudinal end, the liner bag comprising;

- a bag main body incorporated in the container
- connection means for connecting the bag main body at predetermined positions to the container, each of the connection means comprising
- a ring portion formed by drawing a portion of the bag main body into a strip portion and bending the strip portion; and
- a connection mechanism for connecting the ring portion to the container.

In accordance with the present invention, the ring portion is formed by the bag main body itself, and the ring portion is connected by way of the connection mechanism to the container. Therefore, even if cargoes are loaded in the bag main body and a load is exerted on the ring, the bag main body is pulled entirely to prevent an excess load from exerting locally, thereby enabling to effectively prevent breakage of the bag main body.

BRIEF EXPLANATION OF THE ACCOMPANYING DRAWINGS

These and other objects, and advantageous features of the present invention will become apparent by reading the following descriptions for the preferred embodiments according to the present invention with reference to the accompanying drawings, wherein FIG. 1 is a perspective view illustrating a liner bag used for a container according to a first embodiment of the present invention;

Figure 3:
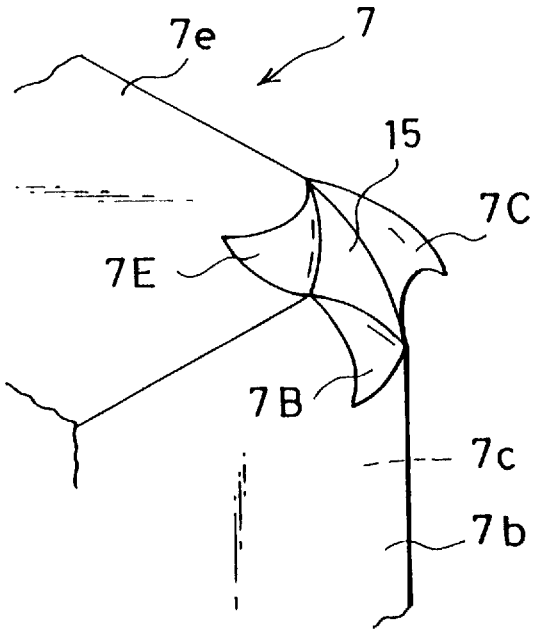
FIG. 3 is an explanatory view illustrating a corner of a bag main body.
Figure 4A:
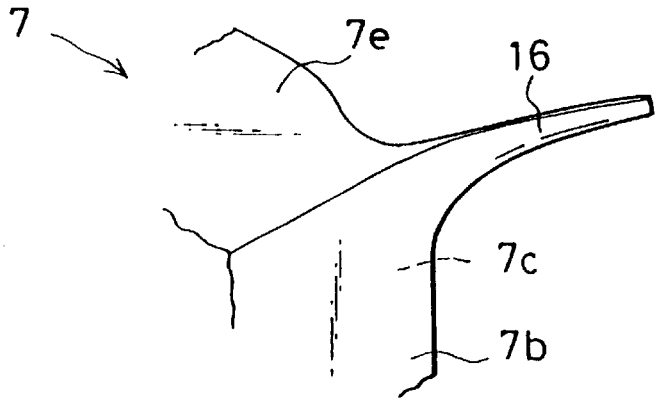
Figure 4B:
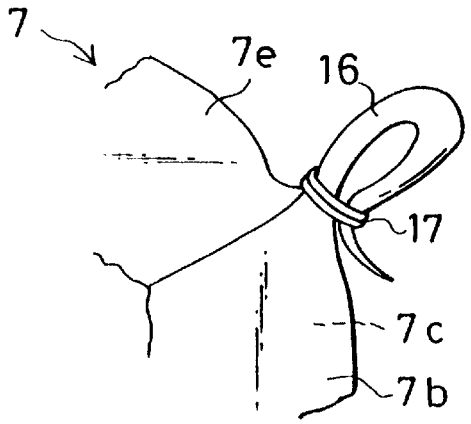
Figure 5:
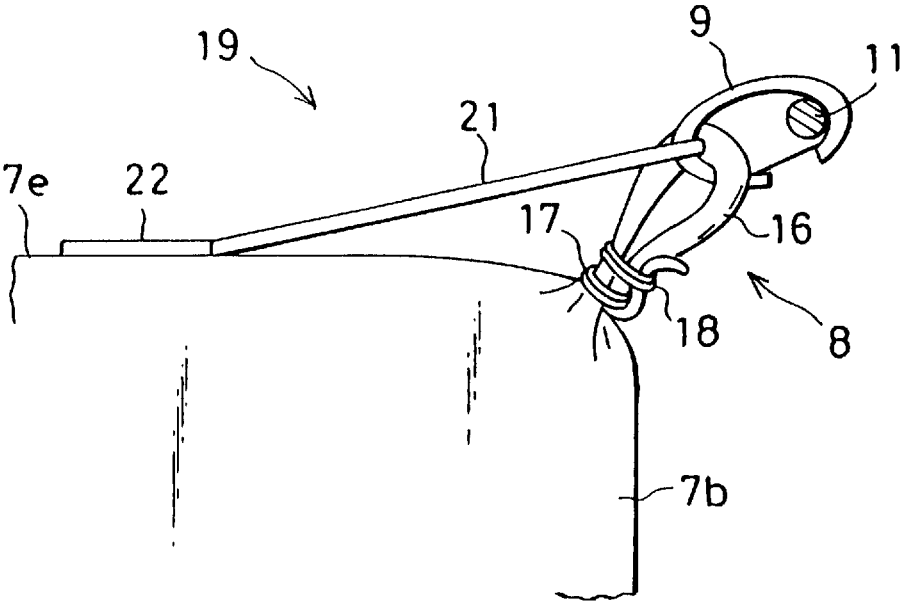
Figure 6:
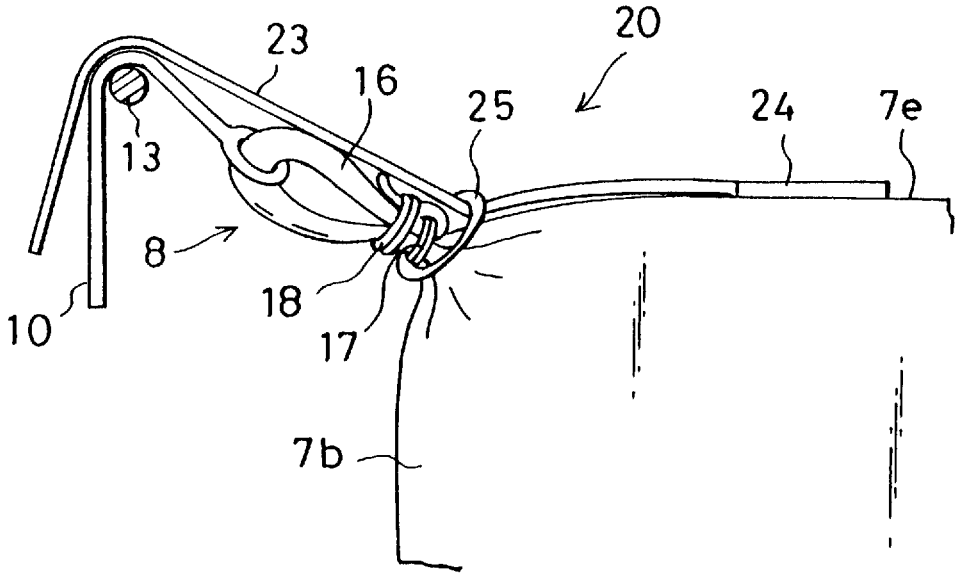
Figure 7A:
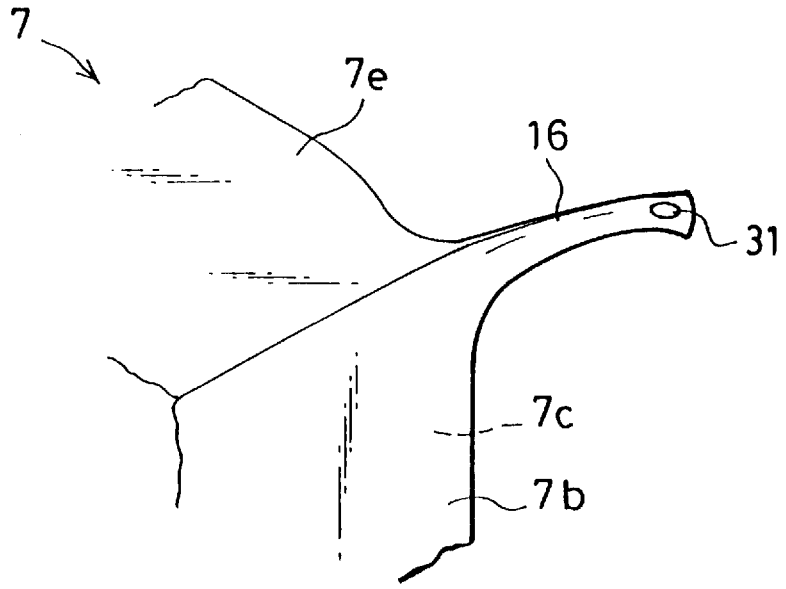
Figure 7B:
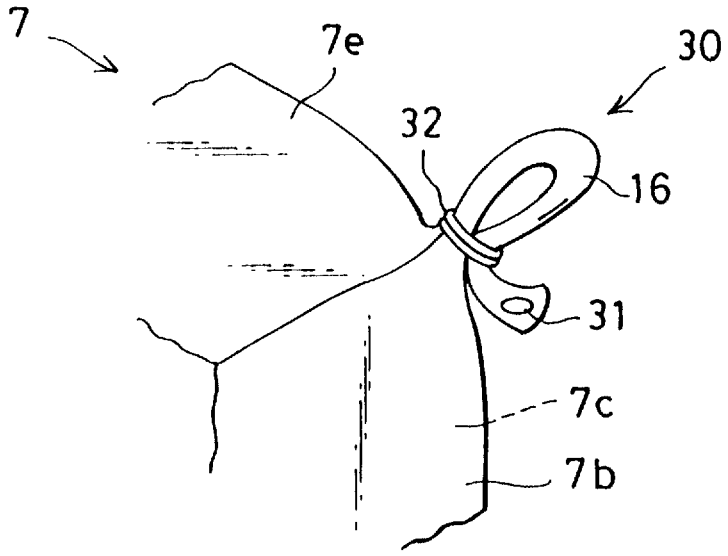
Figure 8A:
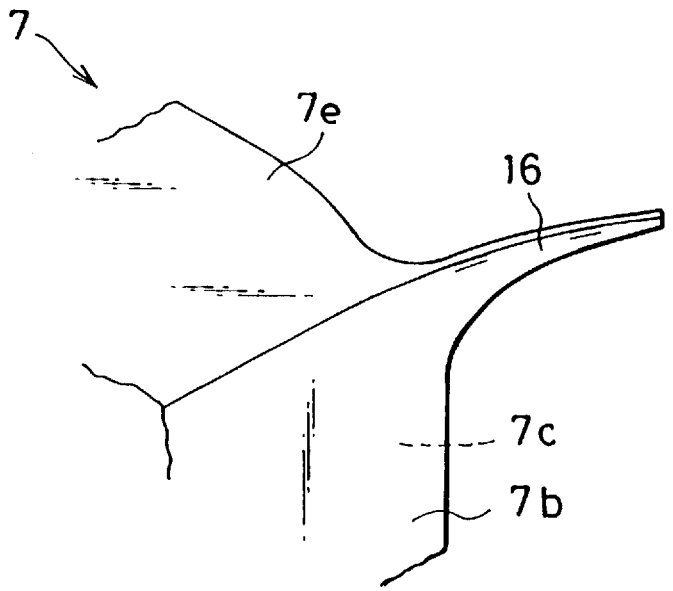
Figure 8B:
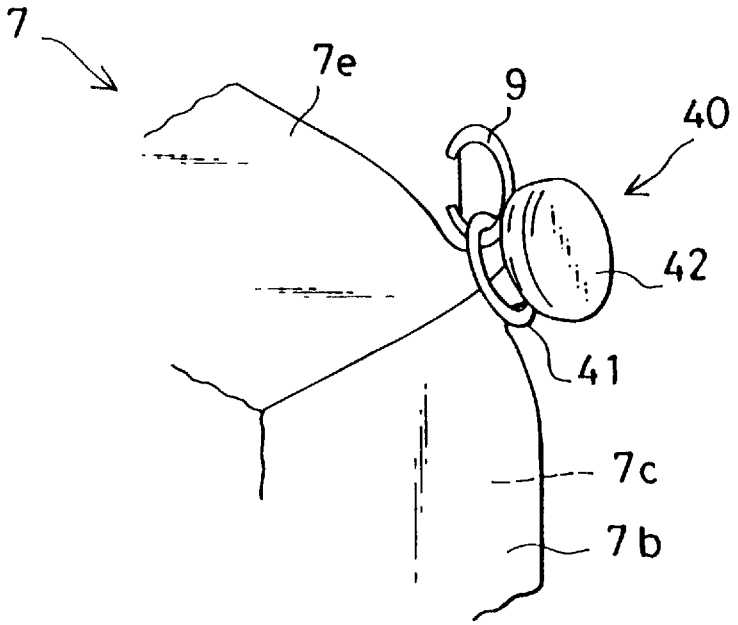
Figure 9A:
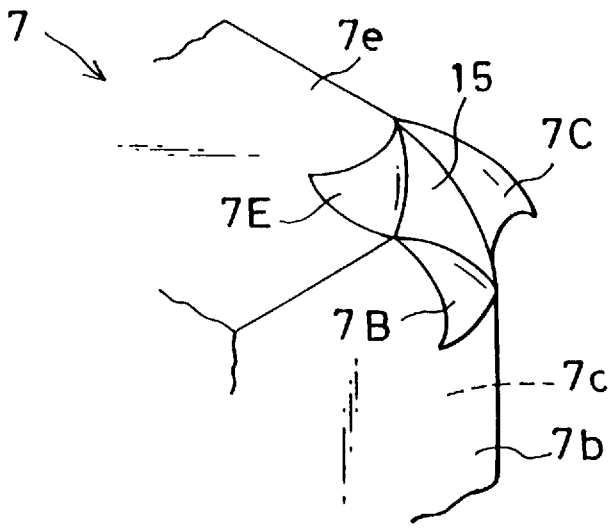
Figure 9B:
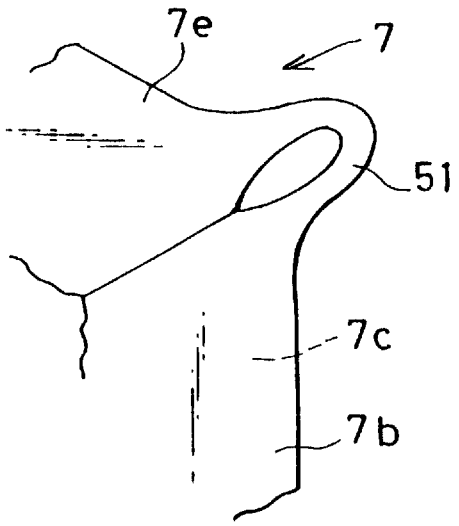
Figure 9C:
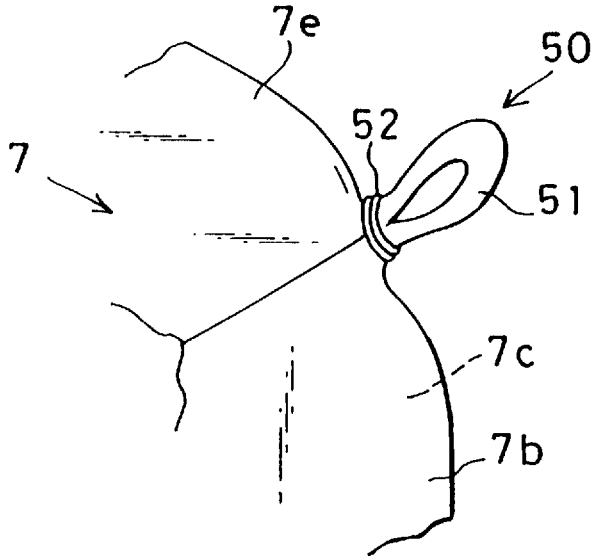
Figure 10A:
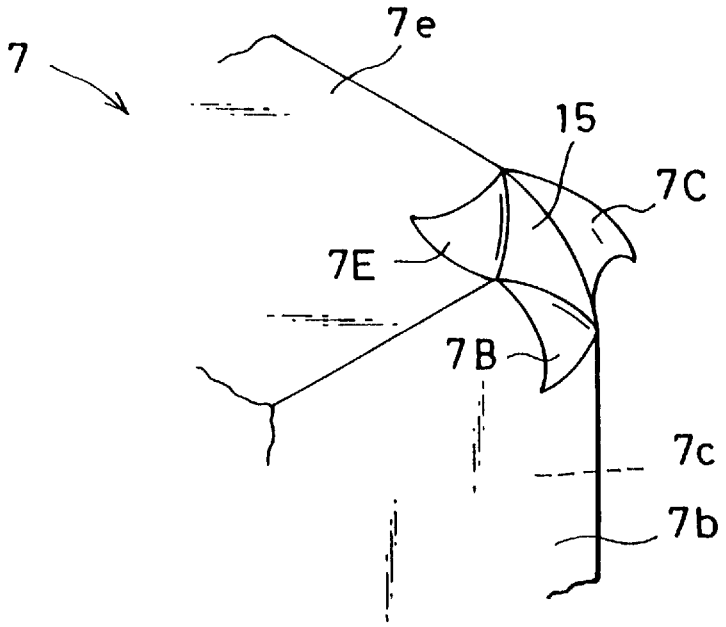
Figure 10B:
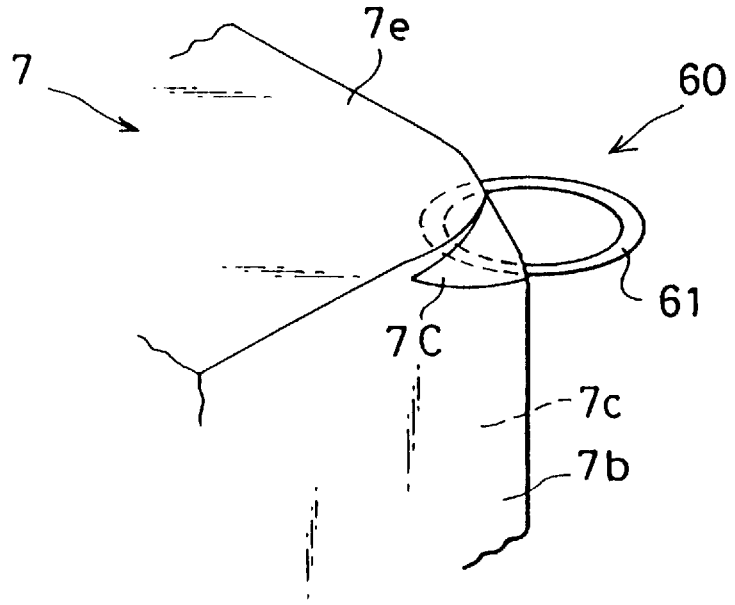
Figure 11A:
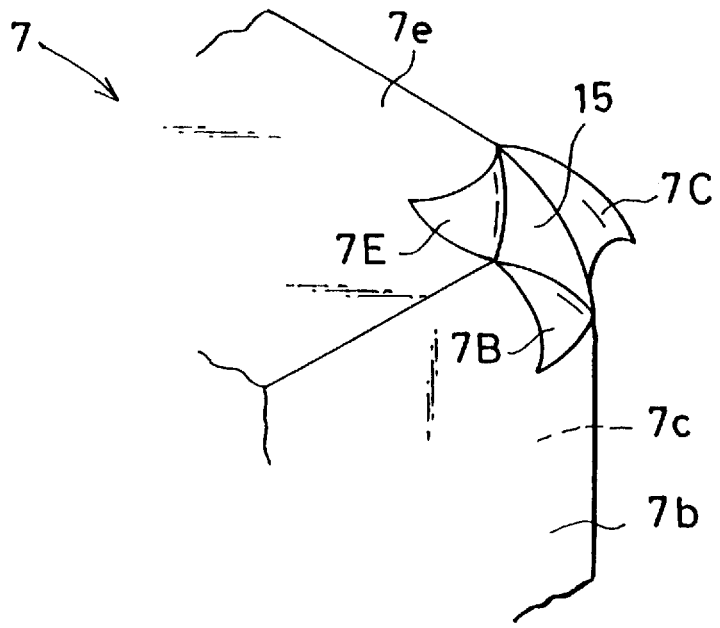
Figure 11B:
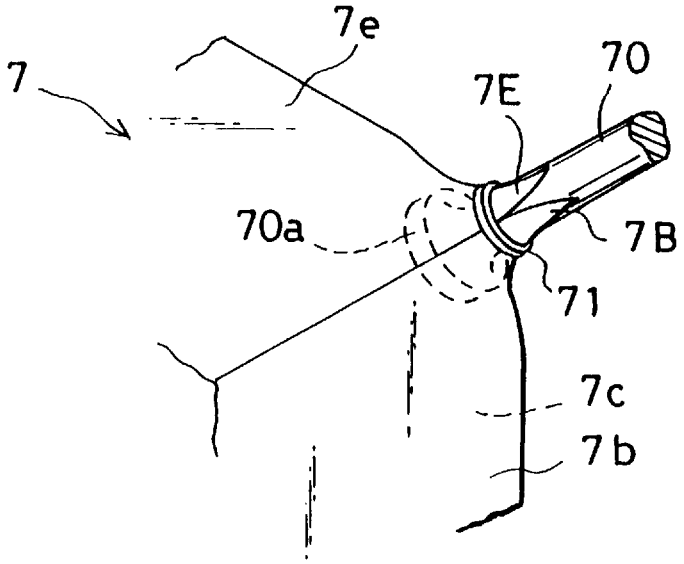
Figure 12A:
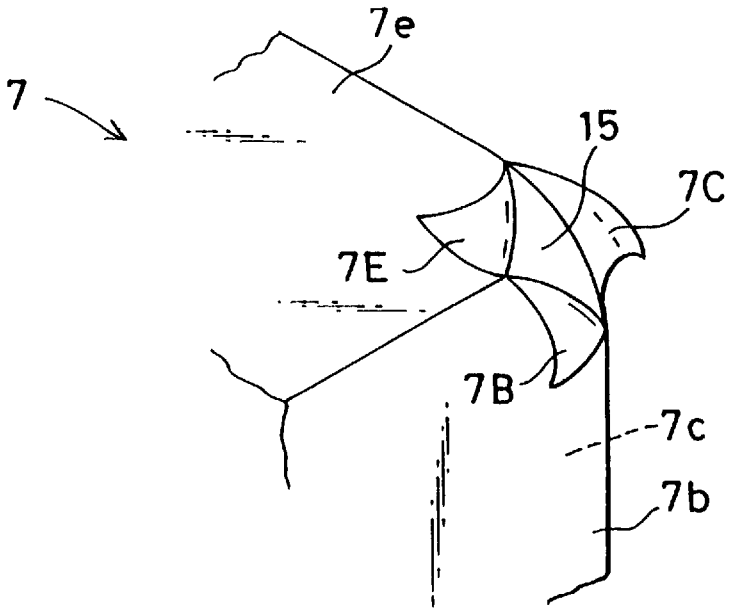
Figure 12B:
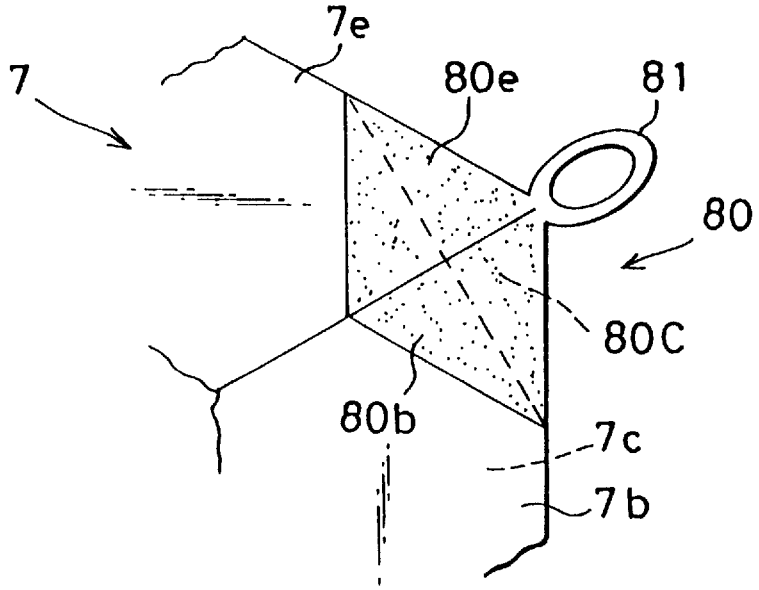

FIG. 4(*a*)–FIG. 4(*c*) are, respectively, explanatory views illustrating a method of forming a ring portion at the corner shown in FIG. 3 successively in accordance with preparing procedures;

FIG. 5 is an explanatory view illustrating a constitution related to a suspending member facing a front face;

FIG. 6 is an explanatory view illustrating a constitution related to a suspending member facing a door;

FIG. 7(*a*) and FIG. 7(*b*) are, respectively, explanatory views illustrating a second embodiment according to the present invention;

FIG. 8(*a*) and FIG. 8(*b*) are, respectively, explanatory views illustrating a third embodiment according to the present invention;

FIGS. 9(*a*), (*b*) and (*c*) are, respectively, explanatory views illustrating a fourth embodiment according to the present invention;

FIG. 10(*a*) and FIG. 10(*b*) are, respectively, explanatory views illustrating a fifth embodiment according to the present invention;

FIG. 11(*a*) and FIG. 11(*b*) are, respectively, explanatory views illustrating a sixth embodiment according to the present invention; and FIG. 12(*a*) and FIG. 12(*b*) are, respectively, explanatory views illustrating a seventh embodiment according to the present invention.

DESCRIPTION OF THE PREFERRED EMBODIMENTS

The present invention will now be explained by way of its preferred embodiments reference to the drawings.

Figure 1:
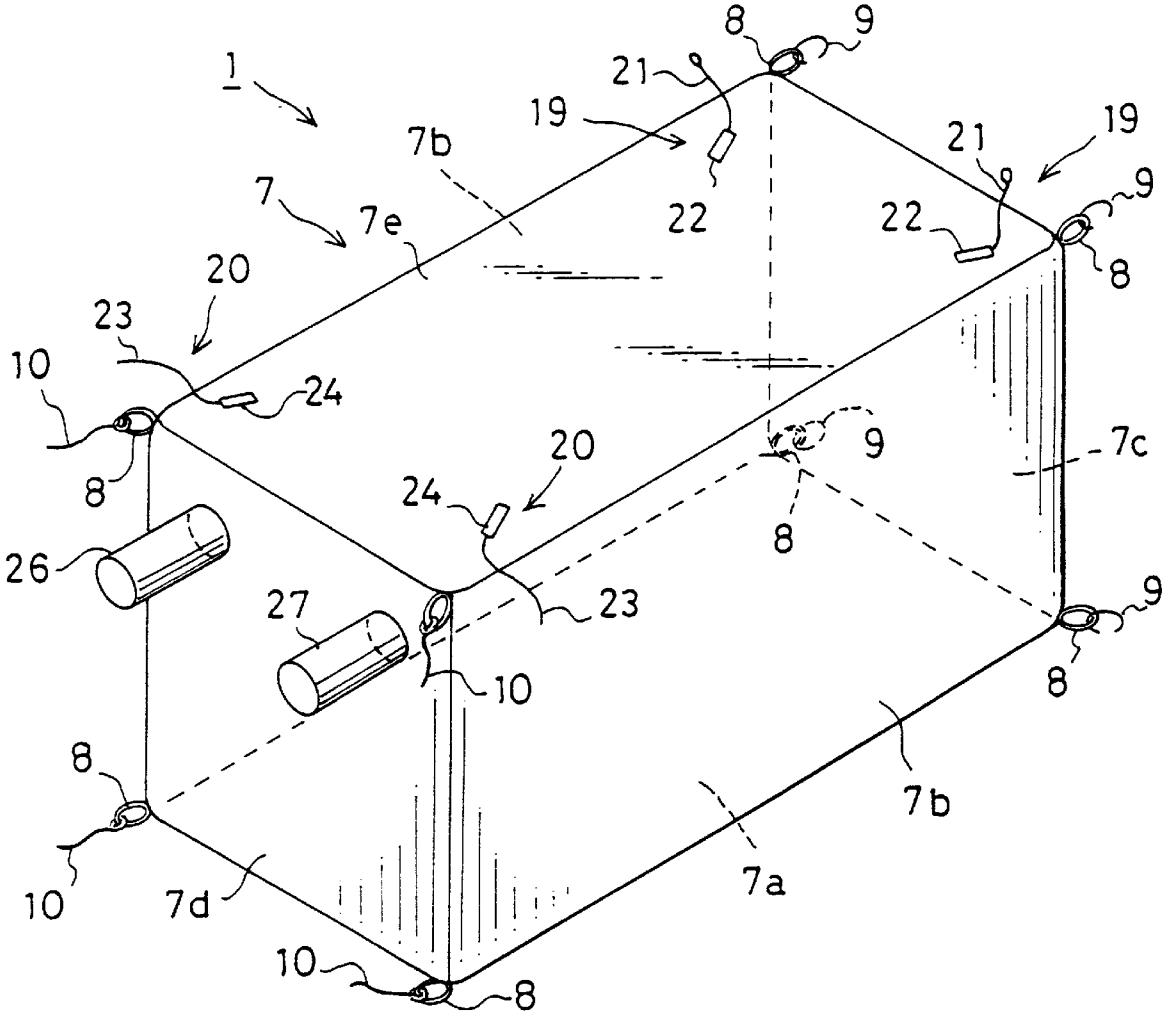
Figure 2:
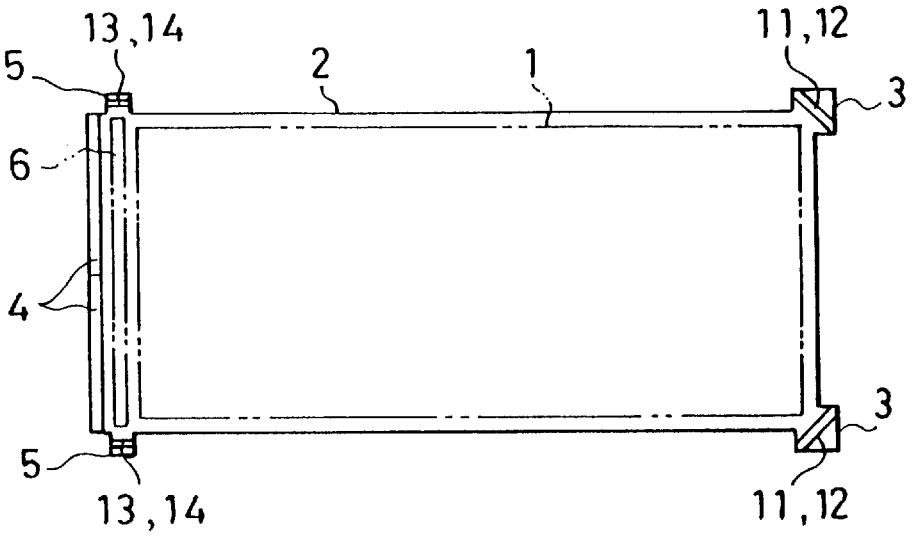
FIG. 2 is a schematic plan view illustrating the liner bag used for a container shown in FIG. 1 in a state mounted in a dry container.

FIG. 1 schematically illustrates a liner bag used for a container according to a first embodiment of the present invention. A liner bag 1 used for a container is detachably mounted, as generally shown in FIG. 2, in a dry container 2 of a longitudinal box-shaped configuration having square grooves 3 at front corners and grooves 5 in a conventional manner recessed rear corners facing a door 4. The end face of the door 4 is supported by a bulkhead 6 mounted detachably in the grooves 5.

As shown in FIG. 1, the liner bag 1 has a bag main body 7 of a tightly sealed rectangular box-shape that conforms the inner configuration of the dry container 2. That is, the bag main body 7 comprises a bottom face 7*a* corresponding to a container bottom wall, a pair of side faces 7*b* corresponding to container side walls, a front face 7*c* corresponding to a container front wall, a door face 7*d* corresponding to the door 4 and a ceiling face 7*e* corresponding to a container ceiling wall. The bag main body 7 is made of a water proof soft sheet such as a plastic film and prepared by cutting the sheet so as to conform the shape for each of the faces 7*a*, 7*b*, 7*c*, 7*d* and 7*e* and heat fusing end edges of them to each other. The main body 7 can be folded compact when it is not used.

As shown in FIGS. 4(*c*) and 5, a ring portion 8 is formed by using the material of the bag main body 7 itself at each of four corners of the front face 7*c* and at each of four corners of the door face 7*d*. A C-shaped ring 9 is disposed to each of ring portions 8 at the four corners of the front face 7*c*. Further, a engaging string 10 is disposed to each of ring portion 8 at four corners of the door face 7*d*. Then, each of the C-shaped rings 9 is engaged to an upper engaging metal rod 11 and a lower engaging metal rod 12 disposed, respectively, to upper and lower ends of the square grooves 3. Each of the engaging strings 10 is bound to an upper engaging rod 13 and a lower engaging rod 14 disposed, respectively, to upper and lower ends of the recessed groove 5.

As shown at a corner formed with the side face 7*b*, the front face 7*c* and the ceiling face 7*e* in FIG. 3, at each of eight corners of the bag main body 7, end pieces 7B, 7C and 7E are left not welded to define an opening 15. The ring portion 8 is formed by gathering each of the end pieces 7B, 7C and 7E, by which an opening 15 can be closed tightly.

Figure 4C:
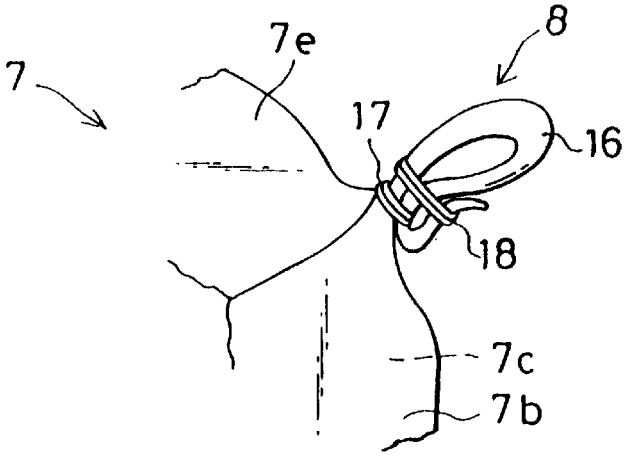

That is, as shown in FIG. 4(*a*), each of the eight corners of the bag main body 7 is drawn into a strip-like shape to form a strip portion 16. As shown in FIG. 4(*b*), the strip portion 16 is twicefolded and then tied by a first tying member 17. Further, as shown in FIG. 4*c*, the top end of the strip portion 16 is turned back again in an opposite direction along an outer circumferential surface of the first tying member 17, and the turned back portion is tied together with the twicefolded strip-portion 16 by a second tying member 18. Then, the strip portion 16 defines the ring 8, and the opening 15 is tightly closed by the two tying members 17, 18.

As shown in FIG. 1, each pair of front suspending members 19 and rear (door-facing) suspending members 20 are disposed on the ceiling face 7*e* each at a position spaced apart from each of the ring portions 8 inwardly by a predetermined distance along a diagonal line so that the ceiling face 7 can be prevented from slackening by outwardly pulling the ceiling face 7*e* obliquely and upwardly by the four suspending members 19, 20.

As shown in FIG. 1 and FIG. 5, the front suspending member 19 comprises a strip-shaped main body 21 made of a highly elastic material such as a hakata elastic webbing and a connection releasing member 22 made, for example, of a PE cloth adhesive tape into a rectangular shape. The top end of the main body 21 is engaged together with the ring portion 8 to the C-shaped ring 9 as shown in FIG. 5. Then, the ceiling face 7*e* is pulled obliquely and upwardly toward the upper engaging metal 11 due to the elasticity of the main body 21 and, upon exertion of an excess load, connection between the connection releasing member 22 and the ceiling face 7*e* is released thereby enabling to prevent breakage of the bag main body 7.

On the other hand, as shown in FIG. 1 and FIG. 6, the rear (door-facing) suspending member 20 comprises, a strip-shaped main body 23 made of the same material as that of the main body 21 and a connection releasing member 24 having the same structure as that of the connection releasing member 22. As shown in FIG. 6, the main body 23 is adapted to pass through the inside of a guide ring 25 mounted to the ring 8 and then bound together with the engaging string 10 to the upper engaging rod 13. Then, the ceiling face 7*e* is pulled obliquely and upwardly toward the upper engaging rod 13 due to the elasticity of the main body 23 and, upon exertion of an excess load, connection between the connection releasing member 24 and the ceiling face 7*e* is released thereby enabling to prevent breakage of the bag main body 7.

As shown in FIG. 1, the rear (door) face 7*d* of the bag main body 7 has, at an upper end portion thereof, a cargo charging port 26 and an air exhaust port 27 each protruding cylindrically. The inside of the bag main body 7 is kept at a completely sealed state by closing both of the ports 26 and 27 using a band or the like.

Description will now be made to the operation of this embodiment.

In a case of mounting the liner bag 1 used for a container to the inside of the dry container 2, the C-shaped rings 9 at the lower end of the front face 7*c* are engaged to the lower engaging metals 12 while the C-shaped rings 9 at the upper end of the front face 7*c* are engaged to the upper engaging metals 11 as shown in FIG. 5.

Then, the engaging strings 10 at the upper end of the rear (door) face 7*d* are bound to the upper engaging rod 13, and the engaging strings 10 at the lower end of the rear (door) face 7*d* are bound to the lower engaging rods 14 and, subsequently, the main bodies 23 of the rear (doorfacing) suspending members 20 are tightly bound to the upper engaging rods 13. Thus, the liner bag 1 is completely mounted to the inside of the dry container 2. Subsequently, as shown in FIG. 2, a bulkhead 6 is mounted and the lower half on the outer side of the rear (door) face 7*d* is supported by the bulkhead 6. In this state, the cargoes are charged through the cargo charging port 26 into the bag main body 7.

By the way, when cargoes are charged in the bag main body 7, the bag main body 7 is entirely pulled downwardly by the weight of the charged cargoes. Therefore, an extremely large load would exert on the connection portions of the bag main body 7 to the dry container 2, particularly, at the ring portions 8 at four corners of the ceiling face 7*e*.

However, as shown in FIG. 4, since the ring portion 8 is formed by the bag main body 7 itself, when a load exerts on the ring portion 8, the bag main body 7 is pulled entirely. Accordingly, different from the existent case of using side edge belts, no excess load is applied locally to a portion of the bag main body 7, and a portion of the bag main body 7 is not weakened, for example, at seam regions stitched by a sewing machine and breakage of the bag main body 7 can be prevented effectively.

Further, since the ring portion 8 is formed by tying with the two tying members 17 and 18, even if a large load exerts on the ring portion 8, there is no worry that the ring portion 8 loses its shape or air tightness at the ring portion 8 is deteriorated. Further, the operation is easy since the ring portion is formed only by the tying operation. Further, in this method, since the ring portion 8 can be formed easily at a portion other than the corner of the bag main body 7, the ring portion 8 can be disposed at any required position. In other words, if the bag main body 7 has no rectangular box-shaped configuration but, for example, has a cylindrical shape, it can be incorporated into the dry container 2 with the ring portions 8 being disposed at optional positions.

FIG. 7(*a*) and FIG. 7(*b*) illustrate a second embodiment of the present invention in which a ring portion 30 is used instead of the ring portion 8 used in the first embodiment.

That is, as shown in FIG. 7(*a*), each of eight corners of the bag main body 7 is drawn into a strip-shape to form a strip portion 16. An eyelet 31 is attached to the top end of the strip portion 16 for providing an anti-slip off function. The eyelet 31 is attached rigidly to the top end of the strip portion 16 to prevent slip-off or, in other words, to prevent the top end of the strip portion 16 from pulling through the tied member 32. As shown in FIG. 7(*b*), the strip portion 16 is at first twicefolded and then tied by a tying member 32 to form a ring portion 30. Other constitutions and the operations are identical with those in the first embodiment.

Then, in this embodiment, while tying is applied at one position by the single tying member 32, since the eyelet 31 is attached at the top end of the strip portion 16 to ensure anti-slip off, a substantially similar effect with that in the first embodiment can be expected. A similar effect can also be obtained by using, instead of the eyelet, other metal member or a molten ball formed by fusing the top end of the strip portion 16.

FIG. 8(*a*) and FIG. 8(*b*) illustrate a third embodiment according the present invention in which a connected portion 40 and a connecting ring 41 attached to the connected portion 40 are used instead of the ring portion 8 in the first embodiment.

That is, as shown in FIG. 8(*a*), each of eight corners of the bag main body 7 is drawn into a strip shape to form a strip portion 16. A molten ball 42 formed by fusing is disposed to the top end of the strip portion 16 as an anti-slip off bulged portion, which constitutes the connected portion 40. Then, the connection ring 41 is attached in an anti-slip off state to the connected portion 40. Other constitutions and operations are identical with those in the first embodiment.

Also in this embodiment, when a load exerts on the connected portion 40, the bag main body 7 is pulled entirely and a similar effect with that in the first embodiment can be expected. Since the opening 15 at the corner of the bag main body 7 (refer to FIG. 3) is completely sealed by the molten ball 42, more effective seal can be attained. A similar effect can also be obtained by bending the strip portion 16, tying it by a tying member and utilizing the tying member as an anti-slip off bulged portion, instead of the molten ball 42.

FIGS. 9(*a*), (*b*) and (*c*) illustrate a fourth embodiment according to the present invention in which a ring 50 comprising an arch-shaped portion 51 and a tying member 52 are used instead of the ring portion 8 in the first embodiment.

Specifically, as shown in FIG. 9(*a*) three end pieces 7B, 7C and 7E define the periphery of an opening 15 at each of eight corners of a bag main body 7 in the same manner as and at a position correspond to those illustrated in FIG. 3, and each of the end pieces 7B, 7C and 7E are welded or bonded being overlapped to each other, to constitute an arch-shaped portion 51. Then, when the base end of the arch-shaped portion 51 is tied by a tying member 52, a ring portion 50 is formed and the opening 15 is tightly closed as shown in FIG. 9(*c*).

Referring more specifically to the constitution of the arch-shaped portion 51, it is formed, for example, by overlapping two end pieces 7C and 7E and welding or bonding them to each other and then welding or bonding the top end thereof with the top end of the end piece 7D.

Other constitutions and operations are identical with those in the first embodiment.

Then, also in this embodiment, since the ring portion 50 is formed with the bag main body 7 itself, a similar effect with that in the first embodiment can be expected. The opening 15 may be closed tightly by welding or bonding the base end of the arch-shaped portion 51 in place of using the tying member 52, and the ring portion 50 can be constituted without using metal member at all in this modified embodiment.

FIG. 10(*a*) and FIG. 10(*b*) show a fifth embodiment according to the present invention, in which a ring portion 60 constituted by a circular connection belt 61 which is a member formed separately from the bag main body 7 is used instead of the ring portion 8 in the first embodiment.

Specifically, as illustrated in FIG. 10(*a*), three end 7C and 7E define the periphery of an opening 15 at each of eight corners of a bag main body 7 in the same manner as and at a position corresponding to those illustrated in FIG. 3. As shown in FIG. 10(*b*), a portion of a circular connection belt 61 is inserted into the opening 15 and, in this state, the end pieces 7B, 7C and 7E are passed through the ring of the circular connection belt 61 and welded or bonded being overlapping to each other. Thus, the opening 15 is closed tightly and the bag main body 7 and the circular connection belt 61 are integrated to constitute a ring portion 60.

Other constitutions and operations are identical with those in the first embodiment.

In this embodiment, the ring portion 60 is constituted with the circular connection belt 61 which is prepared separately from the bag main body 7. When a load exerts on the circular connection belt 61, the bag main body 7 is pulled entirely, so that a similar effect with that in the first embodiment can be expected.

FIG. 11(*a*) and FIG. 11(*b*) illustrate a sixth embodiment according to the present invention in which a connection member 70 and a tying tool 71 are used instead of the ring portion 8 in the first embodiment.

Specifically, as shown in FIG. 11(*a*), three end pieces 7B, 7C and 7E define the periphery of an opening 15 at each of eight corners of a bag main body 7 in the same manner as and at a position corresponding to those illustrated in FIG.

3. As shown in FIG. 11(*b*), a connection member 70 is inserted at a base end as an anti-slip off portion 70*a* in the opening 15 and prevented from coming out of the opening by the base end. The end pieces 7B, 7C and 7E wrap the portion of the outer circumferential surface of the connection member 70 that protrudes out of the opening 70 and are tied and secured thereto by a tying member 71. Thus, the opening 15 is tightly closed and the bag main body 7 and the connection member 70 are integrated.

Other constitutions and operations are identical with those in the first embodiment.

Also in this embodiment, since the connection member 70 and the bag main body 7 are integrated and the entire bag main body 7 is pulled when a load exerts on the connection member 70, a similar effect as that in the first embodiment can be expected. A similar effect can be obtained also by welding or bonding each of the end pieces 7B, 7C and 7E to the connection member 70 instead of using the tying member 71.

FIGS. 12(*a*), (*b*) illustrates a seventh embodiment according to the present invention in which a reinforcing member 80 is welded or bonded to the outer surface at each corner of a bag main body 7 instead of using the ring portion 8 in the first embodiment.

Specifically, as shown in FIG. 12(*a*), three end pieces 7B, 7C and 7E define the periphery of an opening 15 at each of eight corners of a bag main body 7 in the same manner as and at a position corresponding to those illustrated in FIG. 3. As shown in FIG. 12(*b*), a reinforcing member 80 which is formed into a triangular pyramidical shape by reinforcing members 80*b*, 80*c* and 80*c* corresponding, respectively, to a front face 7*b*, a front face 7*c* and a ceiling face 7*e* of the bag main body 7 is welded or bonded to the outer surface of the corner. Then, a ring portion 81 is disposed integrally with the reinforcing member 80.

Other constitutions and operations are identical with those in the first embodiment.

In this embodiment, since the ring portion 81 and the bag main body 7 are integrated by the reinforcing member 80 and the opening 15 is closed tightly, a similar effect with that in first embodiment 1 can be expected. A similar effect can also be obtained by welding or bonding the reinforcing member 80 to the inside at the corner of the bag main body 7 and pulling the ring portion 81 out of the opening 15.

As has been described above, according to the first embodiment of the present invention, since the ring portion is formed with the bag main body itself and the ring portion is connected by way of the connection mechanism to the container, even if a large load exerts on the ring portion, it can be supported by the entire bag main body and no excess load exerts only to a localized portion of the bag main body. Therefore, breakage of the bag main body can be prevented effectively.

Further, since the ring portion is formed by drawing a portion of the bag main body into a strip portion, it can be formed not only at the corner but also at any desired portion of the bag main body. Therefore, there is no particular restriction on the shape or the structure of the bag main body and production cost can be saved.

Further, since the ring portion is formed by using the first tying member and the second caulking member it can be formed only the tying operation to facilitate the production operation. In addition, the ring portion is not collapsed even if a large force exerts since tying is applied at two positions.

Further, according to the second embodiment of the present invention, since the ring portion is formed with the tying member and the anti-slip off portion, the ring portion can be formed with no troubles even if the length of the strip is short.

Further, according to the third embodiment of the present invention, since the anti-slip off portion is formed with the anti-slip off tool such as an eyelet or molten ball, an optimum anti-slip off stopper can be selected in accordance with the material and the production method for the bag main body or the like.

Further, since the connected portion is formed by disposing the anti-slip off bulged portion to the bag main body itself and the connected portion is connected by way of the connection mechanism to the container, the load exerting on the connected member can be supported by the entire bag main body. Therefore, breakage of the bag main body can be prevented effectively.

Further, according to the fourth embodiment of the present invention, since the ring portion is prepared by forming the arch-shaped portion with the bag main body itself and the load exerting on the ring portion can be supported by the entire bag main body. Therefore, breakage of the bag main body can be prevented effectively.

Further, since the tightly closing means is formed with the tying member for tying the base end of the arch-shaped portion, integrity for the ring portion and the bag main body is ensured. When a localized load exerts on the ring, a portion of the bag main body is delivered through the tying member to the ring portion thereby enabling to prevent localized load.

Further, according to the fifth embodiment of the present invention, since the tightly closing means is formed with a tightly closed portion by welding or bonding the base end of the arch-shaped portion, the ring portion can be formed without using any metal member and the air tightness for the ring portion can be ensured sufficiently.

Further, according to the sixth embodiment of the present invention, since the connection means has a connection member connected and secured to the bag main body in a state partially pulled out of the opening disposed to the bag main body, the connection member is completely integrated with the bag main body and, when a load exerts on the connection member, the entire bag main body is pulled. Therefore, no excess load exerts only to a portion of the bag main body thereby enabling to effectively prevent breakage of the bag main body.

Further, since the connection member is connected and secured to the bag main body by tightly closing the opening, there is no requirement for conducting the operation of connecting the connection member to the bag main body and the operation of tightly closing opening separately, so that operation steps can be simplified to reduce the production cost.

Further, since the anti-slip off portion is disposed to the connection member at a position inside the back main body, even when a large force exerts on the connection member, there is no worry that the connection member is detached from the bag main body.

Further, according to the seventh embodiment of the present invention, since the connection means comprises the reinforcing member having the triangular pyramidical shape defined with three faces in perpendicular to each other and the reinforcing member is welded or bonded to the outer or inner surface at the corner of the bag main body, when a load exerts on the reinforcing member, the bag main body is pulled entirely, so that no excess load exerts only to a portion of the bag main body. Therefore, breakage of the bag main body can be prevented effectively.

Further, since the reinforcing member serves also as the member for tightly closing the opening disposed to the corner of the bag main body, no special closing operation is required to simplify the operation and reduce the production cost.

As many apparently widely different embodiments of this invention may be made without departing from the spirit and scope thereof, it is to be understood that the invention is not limited to the specific embodiments thereof except as defined in the appended claims.

What is claimed is:

1. A liner bag used for a container of a longitudinal box-shaped configuration having a hinged door at one longitudinal end, said liner bag comprising:

a bag main body; and connection means for connecting said bag main body at predetermined positions to said container, each of said connection means comprising;

a ring portion formed by drawing a portion of said bag main body into a strip portion and turning and folding the strip portion and tying said folded strip portion with a tying member, and an anti-slip off member disposed at the top end of the strip portion for preventing the top end from slipping through said tying member, and a connection mechanism for connecting said ring portion to said container.

2. A liner bag as defined in claim 1, wherein the anti-slip off member is formed of an eyelet attached to the top end of the strip portion.

* * * * *